United States Patent [19]

Matsuura et al.

[11] 3,953,373

[45] Apr. 27, 1976

[54] VOLTAGE-DEPENDENT RESISTOR

[75] Inventors: Mikio Matsuura; Osamu Makino; Nobuji Nishi, all of Hirakata; Michio Matsuoka, Ibaragi, all of Japan

[73] Assignee: Matsushita Electric Industrial Co., Ltd., Japan

[22] Filed: July 18, 1974

[21] Appl. No.: 489,827

[30] Foreign Application Priority Data

| | | |
|---|---|---|
| July 20, 1973 | Japan | 48-81711 |
| Sept. 4, 1973 | Japan | 48-100047 |
| Sept. 4, 1973 | Japan | 48-100048 |
| Sept. 4, 1973 | Japan | 48-100050 |

[52] U.S. Cl. ..... 252/518; 252/519; 252/520; 252/521; 338/20

[51] Int. Cl.[2] ..... H01B 1/08

[58] Field of Search .....252/518–520; 338/20

[56] References Cited

UNITED STATES PATENTS

| | | | |
|---|---|---|---|
| 3,663,458 | 5/1972 | Masuyama et al. | 252/519 X |
| 3,842,018 | 10/1974 | Ichinose et al. | 252/518 X |

*Primary Examiner*—Leland A. Sebastian
*Assistant Examiner*—E. Suzanne Parr
*Attorney, Agent, or Firm*—Wenderoth, Lind & Ponack

[57] ABSTRACT

A voltage-dependent resistor comprising a sintered body comprising ZnO as a major part and $Bi_2O_3$ and $GeO_2$ as additives with electrodes applied to the opposite surfaces of the sintered body. This voltage-dependent resistor has a low C-value and a high *n*-value in $I=(V/C)^n$ along with high power dissipation for surge energy and high stability to a high D.C. load. Further, other additives such as NiO, $Co_2O_3$, MnO, $TiO_2$ and $Cr_2O_3$ can advantageously be added to the sintered body.

6 Claims, 1 Drawing Figure

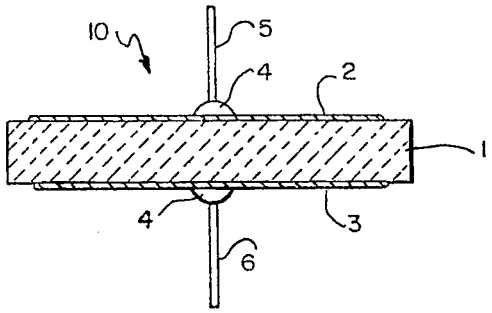
10
5
4
2
1
4
3
6

VOLTAGE-DEPENDENT RESISTOR

This invention relates to a voltage dependent resistors (varistors) having non-ohmic resistance (voltage-dependent property) due to the bulk thereof and more particularly to voltage-dependent resistors, which are suited e.g. for surge absorbers and D.C. stabilizers using zinc oxide, bisumuth oxide and germanium oxide, and optionally cobalt oxide manganese oxide, titanium oxide, chromium oxide and nickel oxide.

Various voltage-dependent resistors such as silicon carbide voltage-dependent resistors, selenium rectifiers and germanium or silicon p-n junction diodes have been widely used for stabilization of voltage of electrical circuits or suppression of abnormally high surge induced in electrical circuits. The electrical characteristics of such voltage-dependent resistors are expressed by the relation:

$$I = (V/C)^n \quad (1)$$

where $V$ is the voltage across the resistor, $I$ is the current flowing through the resistor, $C$ is a constant corresponding to the voltage at a given current and exponent $n$ is a numerical value greater than 1. The value of $n$ is calculated by the following equation:

$$n = \frac{\log_{10}(I_2/I_1)}{\log_{10}(V_2/V_1)} \quad (2)$$

where $V_1$ and $V_2$ are the voltage at given currents $I_1$ and $I_2$, respectively. The desired value of C depends upon the kind of application to which the resistor is to be put. It is ordinarily desirable that the value of $n$ be as large as possible since this exponent determines the extent to which the resistors depart from ohmic characteristics.

Voltage-dependent resistors comprising sintered bodies of zinc oxide with or without additives and non-ohmic electrode applied thereto, have already been disclosed as seen in U.S. Pat. Nos. 3,496,512, 3,570,002, 3,503,029, 3,689,863, and 3,766,098. The nonlinearity (voltage-dependent property) of such voltage-dependent resistors is attributed to the interface between the sintered body of zinc oxide with or without additives and a silver paint electrode, and is controlled mainly by changing the compositions of the sintered body and the silver paint electrode. Therefore, it is not easy to control the C-value over a wide range after the sintered body is prepared. Similarly, in voltage-dependent resistors comprising germanium or silicon p-n junction diodes, it is difficult to control the C-value over a wide range because the nonlinearity of these voltage-dependent resistors is not attributed to the bulk but rather to the p-n junction. In addition, it is almost impossible for those zinc oxide voltage-dependent resistors mentioned above and germanium or silicon diode voltage-dependent resistors to obtain the combination of a C-valve higher than 100 volt, an $n$-value higher than 10 and high surge resistance tolerable for surge more than 100 A.

On the other hand, the silicon carbide voltage-dependent resistors have nonlinearity due to the contacts among the individual grains of silicon carbide bonded together by a ceramic binding material, i.e. to the bulk, and the C-value is controlled by changing a dimension in the direction in which the current flows through the voltage-dependent resistors. In addition, the silicon carbide voltage-dependent resistors have high surge resistance thus rendering them suitable e.g. as surge absorbers. The silicon carbide volage-dependent resistors, however, have a relatively low $n$-value ranging from 3 to 7 which results in poor surge suppression as well as poor D.C. stabilization. Another defect of the silicon carbide voltage-dependent resistor as a D.C. stabilizer is their change in the C-value and the $n$-value during D.C. load application.

There have been known, on the other hand, voltage-dependent resistors of bulk type comprising a sintered body of zinc oxide with additives, as seen in U.S. Pat. Nos. 3,633,458, 3,632,529, 3,634,337, 3,598,763, 3,682,841, 3,642,664, 3,658,725, 3,687,871, 3,723,175, 3,778,743, 3,806,765, 3,811,103 and copending U.S. patent application Ser. No. 29,416. These zinc oxide voltage-dependent resistors contain, as additives, one or more combinations of oxides or fluorides of bismuth, cobalt, manganese, barium, boron, berylium, magnesium, calcium, strontium, titanium, antimony, chromium and nickel, and are controllable in the C-value by changing the distance between electrodes and have an excellent voltage-dependent property in an $n$-value. The powder dissipation for surge energy, however, shows a relatively low value compared with that of the conventional silicon carbide voltage-dependent resistor, so that the change rate of C-value exceeds 20 percent after two standard surges of 8×20 $\mu$sec wave form in a peak current of 500A/cm$^2$ are applied to the zinc oxide voltage-dependent resistors of bulk type. Another defect of these zinc oxide voltage-dependent resistors of bulk type is in their poor stability for D.C. load, particularly in their remarkable decreases of C-value measured even in a current region such as 10 mA after applying a high D.C. powder to the voltage-dependent resistors, especially when they have a C-value less than 70 volts. This deterioration in the C-value especially less than 70 volts is unfavorable e.g. for a voltage stabilizer which devices require high accuracy and low loss for low voltage circuits. This defect of these zinc oxide voltage-dependent resistors of bulk type is presumably mainly due to their low $n$-value for the lower C-value, especially of less than 70 volts. In general, these zinc oxide voltage-dependent resistors of bulk type, mentioned above, have very low $n$-value less than 20, when the C-value is lower than 70 volts. The development of the voltage-dependent resistors having a C-value less than 70 volts have been strongly required for the application of the low voltage circuits, such as automobile industry and home appliances, but the $n$-value of a conventional voltage-dependent resistor having lower C-value is too small to satisfy those uses such as voltage stabilizers and surge absorbers. For these reasons, voltage-dependent resistors of this type having a C-value less than 70 volts have hardly been used in the low voltage applications.

An object of this invention is to provide a voltage-dependent resistor having a low C-value e.g. of less than 70 volts, a high $n$-value, high power dissipation for surge energy and high stability for a high D.C. load.

This and other objects of this invention will become apparent upon consideration of the following detailed description taken together with the accompanying drawing in which the single FIGURE is cross-sectional view of a voltage-dependent resistor in accordance with this invention.

Before proceeding with a detailed description of the voltage-dependent resistor contemplated by this invention, its construction will be described with reference to the single FIGURE wherein reference numeral 10 designates, as a whole, a voltage-dependent resistor comprising, as its active element, a sintered body having a pair of electrodes 2 and 3 in an ohmic contact applied to opposite surfaces thereof. The sintered body 1 is prepared in a manner hereinafter set forth and is any form such as circular, square or rectangular plate form. Wire leads 5 and 6 are attached conductively to the electrodes 2 and 3, respectively, by a connection means 4 such as solder or the like.

A voltage-dependent resistor according to this invention comprises a sintered body of a composition comprising, as an additive, 0.1 to 5.0 mole percent of bismuth oxide ($Bi_2O_3$) and 0.01 to 5.0 mole percent of germanium oxide ($GeO_2$), and the remainder of zinc oxide (ZnO), as a main constituent, and electrodes applied to opposite surfaces of the sintered body. Such a voltage-dependent resistor has non-ohmic resistance (voltage-dependent property) due to the bulk itself. Therefore, its C-value can be changed without impairing the *n*-value by changing the distance between said opposite surfaces. According to this invention, the voltage-dependent resistor has a low C-value and a high *n*-value.

The high stability with respect to a D.C. load can be obtained when the sintered body comprises, as an additive, 0.1 to 5.0 mole percent of bismuth oxide ($Bi_2O_3$), 0.01 to 5.0 mole percent of germanium oxide ($GeO_2$) and 0.1 to 5.0 mole percent of nickel oxide (NiO).

It has been discovered according to this invention that the higher stability with respect to a D.C. load and surge power can be obtained when the sintered body comprises, as an additive, 0.1 to 5.0 mole percent of bismuth oxide ($Bi_2O_3$), 0.01 to 5.0 mole percent of germanium oxide ($GeO_2$) and at least one member selected from the group consisting of 0.1 to 3.0 mole percent of cobalt oxide ($Co_2O_3$) and 0.1 to 3.0 mole percent of manganese oxide (MnO).

According to this invention, the stability with a D.C. load and surge power can be improved when the sintered body comprises, as an additive 0.1 to 5.0 mole percent of bismuth oxide ($Bi_2O_3$), 0.01 to 5.0 mole percent of germanium oxide ($GeO_2$), 0.1 to 5.0 mole percent of nickel oxide (NiO) and at least one member selected from the group consisting of 0.1 to 3.0 mole percent of cobalt oxide $Co_2O_3$) and 0.1 to 3.0 mole percent of manganese oxide (MnO).

According to this invention, the stability with a D.C. load and the stability for surge pulses can be further improved when the sintered body comprises, as an additive, 0.1 to 5.0 mole percent of bismuth oxide ($Bi_2O_3$), 0.1 to 3.0 mole percent of cobalt oxide ($Co_2O_3$), 0.1 to 3.0 mole percent of manganese oxide (MnO), 0.01 to 5.0 mole percent of germanium oxide ($GeO_2$) and at least one member selected from the group consisting of 0.1 to 3.0 mole percent of titanium oxide ($TiO_2$) and 0.01 to 3.0 mole percent of chromium oxide ($Cr_2O_3$). According to this invention, the stability with a D.C. load and the stability for surge pulses can be remarkably improved when the sintered body comprises, as an additive, 0.1 to 5.0 mole percent of bismuth oxide ($Bi_2O_3$), 0.1 to 3.0 mole percent of cobalt oxide ($Co_2O_3$), 0.1 to 3.0 mole percent of manganese oxide (MnO), 0.01 to 5.0 mole percent of germanium oxide ($GeO_2$), 0.1 to 5.0 mole percent of nickel oxide (NiO) and at least one member selected from the group consisting 0.1 to 3.0 mole percent of titanium oxide ($TiO_2$) and 0.01 to 3.0 mole percent of chromium oxide ($Cr_2O_3$).

The sintered body 1 can be prepeared by a per se well known ceramic technique. The starting materials in the compositions in the foregoing description are mixed in a wet mill so as to produce homegeneous mixtures. The mixtures are dried and pressed in a mold into desired shapes at a pressure from 50 kg./cm$^2$ to 500 kg./cm$^2$. The pressed bodies are sintered in air at 1000° to 1450°C for 1 to 20 hours, and then furnace-cooled to room temperature (about 15° to about 30°C). The mixtures can be preliminarily calcined at 600° to 1000°C and pulverized for easy fabrication in the subsequent pressing step. The mixture to be pressed can be admixed with a suitable binder such as water, polyvinyl alcohol, etc. It is advantageous that the sintered body be lapped at the opposite surfaces by abrasive powder such as silicon carbide in a particel size of about 10 to 50$\mu$ in mean diameter. The sintered bodies are provided, at the opposite surfaces thereof, with electrodes in any available and suitable method such as silver painting, vacuum evaporation or flame spraying of metal such as A1, Zn, Sn, etc.

The voltage-dependent properties are not practically affected by the kind of electrodes used, but are affected by the thickness of the sintered bodies. Particularly, the C-value varies in proportion to the thickness of the sintered bodies, while the *n*-value is almost independent of the thickness. This surely means that the voltage-dependent property is due to the bulk itself, but not to the electrodes.

Lead wires can be attached to the electrodes in a per se conventional manner by using conventional solder. It is convenient to employ a conductive adhesive comprising silver powder and resin in an organic solvent in order to connect the lead wires to the electrodes. Voltage-dependent resistors according to this invention have a high stability to temperature, for the D.C. load test which is carried out by applying a rating power of 1 watt at 90°C ambient temperature for 500 hours, and for the surge test which is carried out by applying a surge wave form of 8×20$\mu$sec and 500A/cm$^2$. The *n*-value does not change remarkably after the heating cycles, the load life test, humidity test and surge life test. It is advantageous for achievement of high stability with respect to humidity that the resultant voltage-dependent resistors be embedded in a humidity proof resin such as epoxy resin and phenol resin in a per se well known manner.

The following examples are meant to illustrate preferred embodiment of this invention, but not meant to limit all the scope thereof.

EXAMPLE 1

A starting material composed of 98.0 mole percent of zinc oxide, 1.0 mole percent of bismuth oxide and 1.0 mole percent of germanium oxide was mixed in a wet mill for 24 hours. The mixture was dried and pressed in a mold into discs of 17.5mm in diameter and 7 mm in thckness at a pressure of 250 kg/cm$^2$.

The pressed bodies were sintered in air at the condition shown in Table 1, and then furnace-cooled to room temperature. The sintered body was lapped at the opposite surfaces thereof into the thickness shown in Table 1 by silicon carbide abrasive in particle size of 30$\mu$ in mean diameter. The opposite surfaces of the sintered body were provided with a spray metallized film of aluminum in a per se well known technique.

The electric characteristics of resultant sintered body are shown in Table 1, which shows that the C-value varies approximately in proportion to the thickness of the sintered body while the *n*-value is essentially independent of the thickness. It will be readily recognized that the voltage-dependent property of the sintered body is attributed to the sintered body itself.

EXAMPLE 2

Zinc oxide and additives listed in Table 2 were fabricated into voltage-dependent resistors by the same process as that of Example 1. The thickness was 1.0 mm. The resulting electrical properties are shown in Table 2, in which the value of *n* are the *n*-value defined between 1mA and 10mA. A D.C. life test was carried out by applying a D.C. load of 1 watt at 90°C ambient temperature for 500 hours. It can be easily understood that the combined addition of bismuth oxide and germanium oxide as additives shows a high *n*-value and a low C-value less than 70 volts.

EXAMPLE 3

Zinc oxide and additives of Table 3 were fabricated into voltage-dependent resistors by the same process as that of Example 2. The electrical properties of the resultant resistors are shown in Table 3. The change rates of C and *n* values after a D.C. load test are also shown in Table 3. The test was carried out by applying a D.C. load of 1 watt at 90°C ambient temperature for 500 hours. It will be readily recognized that the further addition of nickel oxide results in a higher *n*-value than those of Example 2. and smaller change rates.

EXAMPLE 4

Zinc oxide and additives of Table 4 were fabricated into voltage-dependent resistors by the same process as that of Example 2. The electrical characteristics of resulting resistors are shown in Table 4. The change rates of C-and *n*-values after a D.C. test carried out by the same method as that of Example 3 and those of impulse test carried out by applying two impulses of 8×20$\mu$ sec and 500A are also shown in Table 4. It will be easily understood that the further addition of at least one member selected from the group consisting of cobalt oxide and manganese oxide results in a small C-value, a high *n*-value and smaller change rate than those of Example 2.

EXAMPLE 5

Zinc oxide and additives of Table 5 were fabricated into voltage-dependent resistors by the same process as that of Example 2. The electrical characteristics of resultant resistors are shown in Table 5. It will be easily understood that the further addition of cobalt oxide and manganese oxide results in small C-value, the high *n*-value and smaller change rates than those of Example 3 and 4. The change rates of C and *n*-values after a D.C. test and an impulse test carried out by the same method as those of Example 4 are also shown in Table 5.

EXAMPLE 6

Zinc oxide and additives of Table 6 were fabricated into voltage-dependent resistors by the same process as that of Example 2. The electrical characteristics of resultant resistors are shown in Table 6. It will be easily understood that the further addition of titanium oxide and/or chromium oxide results in a small C-value less than 70 volts, a high *n*-value over 30 and smaller change rates than those of Example 4. The change rates of C-and *n*-values after a D.C. test and an impulse test carried out by the same method as those of Example 4 are also shown in Table 6.

EXAMPLE 7

Zinc oxide and additives of Table 7 were fabricated into voltage-dependent resistors by the same process as that of Example 2. The electrical characteristics of resultant resistors are shown in Table 7. It will be easily understood that the further addition of titanium oxide and/or chromium oxide results in a small C-value, a high *n*-value and smaller change rates than those of Example 5 and Example 6. The change rates of C-and *n*-values after a D.C. and an impulse test carried out by the same method as those of Example 4 are also shown in Table 7.

EXAMPLE 8

The resistors of Example 2,3,4,5,6, and 7 were tested in accordance with a method widely used in the electronic component parts. A heating cycle test was carried out by repeating 5 times the cycle in which the resistors are kept at 85°C ambient temperature for 30 minutes, cooled rapidly to −20°C and then kept at such temperature for 30 minutes. A humidity test was carried out at 40°C and 95 percent relative humidity for 1000 hrs. Table 8 shows the average change rates of C-value and *n*-value of the resistors after the heating cycle test and the humidity test. It is easily understood that each sample has a small change rate.

Table 1

| Thickness (mm) | C (at 10mA) | n | Sintering Condition |
|---|---|---|---|
| initial (5) | 350 | 15 | 1200°C, 5 Hours |
| 2 | 140 | 15 | " |
| 1 | 70 | 15 | " |
| 0.5 | 35 | 13 | " |
| initial (5) | 300 | 15 | 1350°C, 1 Hour |
| 2 | 120 | 14 | " |
| 1 | 60 | 14 | " |
| 0.5 | 30 | 13 | " |
| initial (5) | 380 | 15 | 1000°C, 20 Hours |
| 2 | 150 | 15 | " |
| 1 | 75 | 15 | " |
| 0.5 | 37 | 13 | " |

Table 2

| Additive (mole %) | | Electrical Properties of Resultant Resistor | | Change Rate after Test (%) | |
|---|---|---|---|---|---|
| $Bi_2O_3$ | $GeO_2$ | C at 10mA | n | ΔC at 10mA | Δn |
| 0.1 | 0.01 | 10 | 14 | −24 | −25 |
| 0.1 | 5.0 | 25 | 16 | −20 | −22 |
| 5.0 | 0.01 | 46 | 17 | −22 | −28 |
| 5.0 | 5.0 | 50 | 18 | −25 | −27 |
| 0.5 | 0.5 | 20 | 15 | −20 | −25 |

Table 3

| Additives (mole%) | | | Electrical Properties of Resultant Resistor | | Change Rate after Test (%) | |
|---|---|---|---|---|---|---|
| $Bi_2O_3$ | $GeO_2$ | NiO | C at 10mA | n | Δ C at 10mA | Δ n |
| 0.1 | 0.01 | 0.1 | 8 | 20 | −15 | −20 |
| 0.1 | 0.01 | 0.5 | 9 | 21 | −14 | −18 |

Table 3-continued

| Additives (mole%) | | | Electrical Properties of Resultant Resistor | | Change Rate after Test (%) | |
|---|---|---|---|---|---|---|
| $Bi_2O_3$ | $GeO_2$ | NiO | C at 10mA | n | Δ C at 10mA | Δ n |
| 0.1 | 0.01 | 5.0 | 10 | 21 | −14 | −19 |
| 0.1 | 0.5 | 0.1 | 12 | 22 | −15 | −19 |
| 0.1 | 0.5 | 0.5 | 13 | 23 | −14 | −17 |
| 0.1 | 0.5 | 5.0 | 12 | 23 | −13 | −16 |
| 0.1 | 5.0 | 0.1 | 16 | 25 | −15 | −17 |
| 0.1 | 5.0 | 0.5 | 14 | 25 | −13 | −17 |
| 0.1 | 5.0 | 5.0 | 13 | 24 | −15 | −19 |
| 0.5 | 0.01 | 0.1 | 27 | 27 | −13 | −15 |
| 0.5 | 0.01 | 0.5 | 18 | 26 | −11 | −13 |
| 0.5 | 0.01 | 5.0 | 27 | 26 | −12 | −14 |
| 0.5 | 0.5 | 0.1 | 23 | 28 | −12 | −15 |
| 0.5 | 0.5 | 0.5 | 15 | 30 | −10 | −13 |
| 0.5 | 0.5 | 5.0 | 34 | 29 | −14 | −16 |

Table 3-continued

| Additives (mole%) | | | Electrical Properties of Resultant Resistor | | Change Rate after Test (%) | |
|---|---|---|---|---|---|---|
| $Bi_2O_3$ | $GeO_2$ | NiO | C at 10mA | n | Δ C at 10mA | Δ n |
| 0.5 | 5.0 | 0.1 | 28 | 28 | −13 | −16 |
| 0.5 | 5.0 | 0.5 | 31 | 28 | −12 | −14 |
| 0.5 | 5.0 | 5.0 | 29 | 28 | −11 | −15 |
| 5.0 | 0.01 | 0.1 | 46 | 29 | −12 | −19 |
| 5.0 | 0.01 | 0.5 | 44 | 27 | −13 | −16 |
| 5.0 | 0.01 | 5.0 | 43 | 29 | −14 | −18 |
| 5.0 | 0.5 | 0.1 | 40 | 30 | −10 | −15 |
| 5.0 | 0.5 | 0.5 | 49 | 27 | −15 | −17 |
| 5.0 | 0.5 | 5.0 | 55 | 30 | −15 | −18 |
| 5.0 | 5.0 | 0.1 | 45 | 29 | −14 | −16 |
| 5.0 | 5.0 | 0.5 | 46 | 29 | −14 | −18 |
| 5.0 | 5.0 | 5.0 | 45 | 30 | −15 | −20 |

Table 4

| Additives (mole %) | | | | Electrical Properties of Resultant Resistor | | Change Rate after DC Life Test (%) | | Change Rate after Impulse Test (%) | |
|---|---|---|---|---|---|---|---|---|---|
| $Bi_2O_3$ | $Co_2O_3$ | $MnO_2$ | $GeO_2$ | C at 10mA | n | ΔC at 10mA | Δn | Δ C at 10mA | Δn |
| 0.1 | 0.1 | — | 0.01 | 16 | 30 | −8.3 | −9.0 | −8.0 | −13 |
| 0.1 | 0.1 | — | 5.0 | 39 | 34 | −7.5 | −9.5 | −7.0 | −12 |
| 5.0 | 3.0 | — | 0.01 | 50 | 32 | −7.0 | −9.0 | −8.5 | −13 |
| 5.0 | 3.0 | — | 5.0 | 56 | 33 | −7.5 | −9.5 | −7.3 | −10 |
| 0.5 | 0.5 | — | 0.5 | 20 | 35 | −7.9 | −10 | −6.8 | −11 |
| 0.1 | — | 0.1 | 0.01 | 11 | 31 | −11 | −14 | −9.1 | −13 |
| 0.1 | — | 0.1 | 5.0 | 30 | 30 | −10 | −14 | − 9.6 | −15 |
| 5.0 | — | 3.0 | 0.01 | 50 | 34 | −11 | −15 | −10 | −16 |
| 5.0 | — | 3.0 | 5.0 | 61 | 35 | −12 | −15 | −10 | −15 |
| 0.5 | — | 0.5 | 0.5 | 25 | 30 | −10 | −14 | −10 | −13 |
| 0.1 | 0.1 | 0.1 | 0.01 | 18 | 31 | −6.4 | −10 | −5.1 | −9.0 |
| 0.1 | 0.1 | 0.1 | 5.0 | 28 | 34 | −6.7 | −10 | −6.0 | −9.1 |
| 0.1 | 3.0 | 0.1 | 0.01 | 30 | 34 | −5.1 | −9.0 | −5.0 | −10 |
| 0.1 | 0.1 | 3.0 | 0.01 | 32 | 31 | −6.3 | −9.8 | −6.3 | −9.1 |
| 5.0 | 0.1 | 0.1 | 0.01 | 31 | 31 | −6.7 | −13 | −6.1 | −8.3 |
| 0.1 | 0.1 | 3.0 | 5.0 | 33 | 30 | −6.5 | −11 | −6.4 | −8.0 |
| 0.1 | 3.0 | 0.1 | 5.0 | 34 | 36 | −5.4 | −9.0 | −5.0 | −7.0 |
| 5.0 | 0.1 | 0.1 | 5.0 | 36 | 35 | −6.2 | −11 | −5.5 | −7.2 |
| 0.1 | 3.0 | 3.0 | 0.01 | 36 | 33 | −5.6 | −9.1 | −5.7 | −8.1 |
| 5.0 | 0.1 | 3.0 | 0.01 | 39 | 31 | −5.8 | −10 | −6.3 | −7.5 |
| 5.0 | 3.0 | 0.1 | 0.01 | 38 | 34 | −5.1 | −9.1 | −6.0 | −8.3 |
| 0.1 | 3.0 | 3.0 | 5.0 | 51 | 33 | −6.3 | −11 | −5.5 | −9.1 |
| 5.0 | 0.1 | 3.0 | 5.0 | 53 | 36 | −6.0 | −9.5 | −6.2 | −9.0 |
| 5.0 | 3.0 | 0.1 | 5.0 | 51 | 36 | −6.5 | −9.0 | −6.4 | −9.0 |
| 5.0 | 3.0 | 3.0 | 0.01 | 53 | 35 | −6.3 | −9.1 | −6.0 | −8.1 |
| 5.0 | 3.0 | 3.0 | 5.0 | 60 | 34 | −6.2 | −10 | −5.1 | −8.0 |
| 0.5 | 0.5 | 0.5 | 0.5 | 27 | 37 | −4.7 | −10 | −5.1 | −8.2 |

Table 5

| Additives (mole %) | | | | | Electrical Properties of Resultant Resistor | | Change Rate after DC Life Test (%) | | Change Rate after Impulse Test (%) | |
|---|---|---|---|---|---|---|---|---|---|---|
| $Bi_2O_3$ | $Co_2O_3$ | MnO | $GeO_2$ | NiO | C at 10mA | n | ΔC at 10mA | Δn | ΔC at 10mA | Δn |
| 0.1 | 0.1 | — | 0.01 | 0.1 | 10 | 30 | −5.2 | −5.2 | −7.2 | −8.0 |
| 0.1 | 0.1 | — | 0.01 | 0.4 | 12 | 31 | −5.8 | −5.7 | −6.0 | −7.1 |
| 0.1 | 0.1 | — | 0.01 | 5.0 | 15 | 31 | −6.5 | −6.6 | −5.4 | −6.5 |
| 0.5 | 0.5 | — | 0.5 | 0.1 | 27 | 35 | −6.0 −6.3 | −5.5 | −6.2 | |
| 0.5 | 0.5 | — | 0.5 | 0.5 | 20 | 30 | −6.2 | −6.5 | −5.3 | −7.0 |
| 0.5 | 0.5 | — | 0.5 | 5.0 | 39 | 36 | −7.0 | −7.3 | −4.5 | −7.5 |
| 5.0 | 3.0 | — | 5.0 | 0.1 | 52 | 37 | −5.3 | −6.0 | −4.8 | −8.0 |
| 5.0 | 3.0 | — | 5.0 | 0.5 | 55 | 38 | −6.2 | −7.2 | −5.1 | −7.0 |
| 5.0 | 3.0 | — | 5.0 | 5.0 | 60 | 36 | −7.0 | −8.0 | −4.3 | −6.1 |
| 0.1 | — | 0.1 | 0.01 | 0.1 | 12 | 30 | −6.2 | −6.2 | −7.5 | −8.5 |
| 0.1 | — | 0.1 | 0.01 | 0.5 | 14 | 30 | −6.3 | −6.2 | −6.2 | −7.6 |
| 0.1 | — | 0.1 | 0.01 | 5.0 | 16 | 30 | −6.9 | −7.0 | −5.8 | −7.0 |
| 0.5 | — | 0.5 | 0.5 | 0.1 | 29 | 33 | −6.4 | −6.3 | −6.5 | −6.8 |
| 0.5 | — | 0.5 | 0.5 | 0.5 | 23 | 35 | −6.6 | −7.0 | −5.1 | −7.6 |
| 0.5 | — | 0.5 | 0.5 | 5.0 | 43 | 36 | −7.2 | −7.8 | −4.3 | −8.0 |
| 5.0 | — | 3.0 | 5.0 | 0.1 | 55 | 37 | −6.3 | −6.1 | −4.2 | −8.9 |
| 5.0 | — | 3.0 | 5.0 | 0.5 | 60 | 37 | −7.2 | −7.0 | −3.5 | −7.5 |
| 5.0 | — | 3.0 | 5.0 | 5.0 | 63 | 35 | −8.0 | −7.5 | −3.5 | −6.9 |
| 0.1 | 0.1 | 0.1 | 0.01 | 0.1 | 14 | 35 | −3.5 | −4.2 | −3.3 | −5.8 |
| 0.1 | 0.1 | 0.1 | 0.01 | 0.5 | 17 | 35 | −3.8 | −5.3 | −3.2 | −5.3 |
| 0.1 | 0.1 | 0.1 | 0.01 | 5.0 | 20 | 36 | −4.2 | −4.8 | −3.1 | −4.0 |

Table 5-continued

| Additives (mole %) | | | | | Electrical Properties of Resultant Resistor | | Change Rate after DC Life Test (%) | | Change Rate after Impulse Test (%) | |
|---|---|---|---|---|---|---|---|---|---|---|
| $Bi_2O_3$ | $Co_2O_3$ | MnO | $GeO_2$ | NiO | C at 10mA | n | ΔC at 10mA | Δn | ΔC at 10mA | Δn |
| 0.5 | 0.5 | 0.5 | 0.5 | 0.1 | 31 | 37 | −4.3 | −4.9 | −3.0 | −5.0 |
| 0.5 | 0.5 | 0.5 | 0.5 | 0.5 | 28 | 35 | −4.8 | −4.7 | −3.8 | −5.9 |
| 0.5 | 0.5 | 0.5 | 0.5 | 5.0 | 46 | 37 | −5.0 | −4.5 | −3.3 | −4.3 |
| 5.0 | 3.0 | 3.0 | 5.0 | 0.1 | 58 | 37 | −3.9 | −3.8 | −3.5 | −4.2 |
| 5.0 | 3.0 | 3.0 | 5.0 | 0.5 | 59 | 37 | −4.9 | −4.6 | −3.9 | −4.5 |
| 5.0 | 3.0 | 3.0 | 5.0 | 5.0 | 60 | 38 | −5.0 | −5.2 | −4.0 | −4.1 |

Table 6

| Additives (mole %) | | | | | | | Electrical Properties of Resultant Resistor | | Change Rate after DC Life Test (%) | | Change Rate after Impulse Test (%) | |
|---|---|---|---|---|---|---|---|---|---|---|---|---|
| $Bi_2O_3$ | $Co_2O_3$ | MnO | $TiO_2$ | $Cr_2O_3$ | Further additives | | C at 10mA | n | ΔC at 10mA | Δn | ΔC at 10mA | Δn |
| 0.1 | 0.1 | 0.1 | 0.1 | — | $GeO_2$ | 0.01 | 19 | 32 | −3.6 | −4.9 | −4.5 | −4.8 |
| 0.1 | 0.1 | 0.1 | 3.0 | — | $GeO_2$ | 0.01 | 16 | 32 | −3.9 | −4.8 | −4.6 | −4.4 |
| 0.1 | 0.1 | 0.1 | 0.1 | — | $GeO_2$ | 5.0 | 29 | 34 | −3.4 | −4.6 | −4.3 | −3.8 |
| 0.1 | 0.1 | 0.1 | 3.0 | — | $GeO_2$ | 5.0 | 24 | 35 | −3.3 | −4.5 | −4.2 | −3.4 |
| 0.5 | 0.5 | 0.5 | 0.5 | — | $GeO_2$ | 0.5 | 24 | 37 | −2.9 | −4.3 | −4.0 | −3.5 |
| 5.0 | 3.0 | 3.0 | 0.1 | — | $GeO_2$ | 0.01 | 50 | 36 | −2.0 | −4.5 | −4.0 | −3.5 |
| 5.0 | 3.0 | 3.0 | 3.0 | — | $GeO_2$ | 0.01 | 36 | 34 | −2.8 | −5.0 | −4.7 | −4.1 |
| 5.0 | 3.0 | 3.0 | 0.1 | — | $GeO_2$ | 5.0 | 59 | 35 | −2.0 | −3.8 | −3.3 | −4.4 |
| 5.0 | 3.0 | 3.0 | 3.0 | — | $GeO_2$ | 5.0 | 43 | 37 | −3.3 | −4.3 | −4.2 | −4.5 |
| 0.1 | 0.1 | 0.1 | — | 0.01 | $GeO_2$ | 0.01 | 22 | 31 | −3.8 | −4.1 | −4.0 | −4.1 |
| 0.1 | 0.1 | 0.1 | — | 3.0 | $GeO_2$ | 0.01 | 33 | 32 | −2.9 | −3.5 | −3.5 | −3.8 |
| 0.1 | 0.1 | 0.1 | — | 0.01 | $GeO_2$ | 5.0 | 31 | 35 | −3.0 | −3.9 | −4.9 | −4.4 |
| 0.1 | 0.1 | 0.1 | — | 3.0 | $GeO_2$ | 5.0 | 46 | 35 | −2.5 | −3.5 | −3.4 | −4.4 |
| 0.5 | 0.5 | 0.5 | — | 0.5 | $GeO_2$ | 0.5 | 52 | 36 | −2.5 | −2.1 | −2.0 | −3.6 |
| 5.0 | 3.0 | 3.0 | — | 0.01 | $GeO_2$ | 0.01 | 56 | 35 | −2.2 | −3.3 | −2.8 | −3.3 |
| 5.0 | 3.0 | 3.0 | — | 3.0 | $GeO_2$ | 0.01 | 70 | 36 | −2.0 | −3.6 | −3.3 | −3.5 |
| 5.0 | 3.0 | 3.0 | — | 0.01 | $GeO_2$ | 5.0 | 63 | 35 | −2.2 | −3.7 | −3.7 | −3.4 |
| 5.0 | 3.0 | 3.0 | — | 3.0 | $GeO_2$ | 5.0 | 71 | 35 | −2.3 | −3.5 | −3.5 | −4.5 |
| 0.1 | 0.1 | 0.1 | 0.1 | 0.01 | $GeO_2$ | 0.01 | 20 | 32 | −1.4 | −1.2 | −1.6 | −1.5 |
| 0.1 | 0.1 | 0.1 | 0.1 | 0.01 | $GeO_2$ | 0.5 | 26 | 32 | −1.1 | −1.5 | −1.1 | −1.5 |
| 0.1 | 0.1 | 0.1 | 0.1 | 0.01 | $GeO_2$ | 5.0 | 32 | 34 | −1.3 | −1.3 | −1.5 | −1.6 |
| 0.5 | 0.5 | 0.5 | 0.5 | 0.01 | $GeO_2$ | 0.5 | 21 | 35 | −1.4 | −1.4 | −1.5 | −1.6 |
| 0.5 | 0.5 | 0.5 | 0.5 | 0.5 | $GeO_2$ | 0.5 | 27 | 38 | −1.2 | −1.5 | −1.6 | −1.2 |
| 0.5 | 0.5 | 0.5 | 0.5 | 3.0 | $GeO_2$ | 0.5 | 39 | 38 | −1.8 | −1.1 | −1.8 | −1.8 |
| 5.0 | 3.0 | 3.0 | 3.0 | 0.01 | $GeO_2$ | 5.0 | 51 | 36 | −1.0 | −1.9 | −1.1 | −1.4 |
| 5.0 | 3.0 | 3.0 | 3.0 | 0.5 | $GeO_2$ | 5.0 | 56 | 37 | −1.2 | −1.9 | −1.1 | −1.5 |
| 5.0 | 3.0 | 3.0 | 3.0 | 3.0 | $GeO_2$ | 5.0 | 67 | 36 | −1.5 | −1.1 | −1.5 | −1.1 |

Table 7

| Additives (mole %) | | | | | | | Electrical Properties of Resultant Resistor | | Change Rate after DC Life Test (%) | | Change Rate after Impulse Test (%) | |
|---|---|---|---|---|---|---|---|---|---|---|---|---|
| $Bi_2O_3$ | $Co_2O_3$ | MnO | $GeO_2$ | NiO | $TiO_2$ | $Cr_2O_3$ | C at 10mA | n | ΔC at 10mA | Δn | ΔC at 10mA | Δn |
| 0.1 | 0.1 | 0.1 | 0.01 | 0.1 | 0.1 | — | 13 | 35 | −0.8 | −0.9 | +0.8 | −0.5 |
| 0.1 | 0.1 | 0.1 | 0.01 | 0.1 | 0.5 | — | 11 | 32 | −0.5 | −0.9 | +0.7 | −0.4 |
| 0.1 | 0.1 | 0.1 | 0.01 | 0.1 | 3.0 | — | 9 | 30 | −0.7 | −0.8 | +0.7 | −0.6 |
| 0.5 | 0.5 | 0.5 | 0.5 | 0.5 | 0.1 | — | 27 | 35 | −0.9 | −0.9 | +0.3 | −0.5 |
| 0.5 | 0.5 | 0.5 | 0.5 | 0.5 | 0.5 | — | 22 | 35 | −0.6 | −0.7 | +0.2 | −0.2 |
| 0.5 | 0.5 | 0.5 | 0.5 | 0.5 | 3.0 | — | 19 | 34 | −0.8 | −0.8 | +0.3 | −0.3 |
| 5.0 | 3.0 | 3.0 | 5.0 | 5.0 | 0.1 | — | 65 | 38 | −0.9 | −0.6 | +0.5 | −0.6 |
| 5.0 | 3.0 | 3.0 | 5.0 | 5.0 | 0.5 | — | 57 | 37 | −0.7 | −0.6 | +0.4 | −0.5 |
| 5.0 | 3.0 | 3.0 | 5.0 | 5.0 | 3.0 | — | 40 | 35 | −0.7 | −0.6 | +0.8 | −0.8 |
| 0.1 | 0.1 | 0.1 | 0.01 | 0.1 | — | 0.01 | 14 | 35 | −0.9 | −0.9 | +0.5 | −0.7 |
| 0.1 | 0.1 | 0.1 | 0.01 | 0.1 | — | 0.5 | 25 | 36 | −0.6 | −0.7 | +0.4 | −0.6 |
| 0.1 | 0.1 | 0.1 | 0.01 | 0.1 | — | 3.0 | 45 | 38 | −0.6 | −0.8 | +0.6 | −0.8 |
| 0.5 | 0.5 | 0.5 | 0.5 | 0.5 | — | 0.01 | 28 | 35 | −0.7 | −0.9 | +0.5 | −0.9 |
| 0.5 | 0.5 | 0.5 | 0.5 | 0.5 | — | 0.5 | 37 | 38 | −0.6 | −0.6 | +0.3 | −0.6 |
| 0.5 | 0.5 | 0.5 | 0.5 | 0.5 | — | 3.0 | 52 | 38 | −0.7 | −0.7 | +0.4 | +0.1 |
| 5.0 | 3.0 | 3.0 | 5.0 | 5.0 | — | 0.01 | 60 | 35 | −0.9 | −0.8 | +0.7 | −0.3 |
| 5.0 | 3.0 | 3.0 | 5.0 | 5.0 | — | 0.5 | 65 | 37 | −0.6 | −0.7 | +0.5 | −0.5 |
| 5.0 | 3.0 | 3.0 | 5.0 | 5.0 | — | 3.0 | 70 | 36 | −0.6 | −0.7 | +0.6 | −0.7 |
| 0.1 | 0.1 | 0.1 | 0.01 | 0.1 | 0.1 | 0.01 | 15 | 35 | +0.3 | +0.3 | −0.2 | +0.5 |
| 0.1 | 0.1 | 0.1 | 0.01 | 0.1 | 0.1 | 0.5 | 27 | 36 | +0.2 | +0.1 | −0.1 | +0.4 |
| 0.1 | 0.1 | 0.1 | 0.01 | 0.1 | 0.1 | 3.0 | 50 | 36 | +0.1 | +0.2 | −0.4 | +0.5 |
| 0.5 | 0.5 | 0.5 | 0.5 | 0.5 | 0.5 | 0.01 | 23 | 38 | +0.2 | +0.3 | ±0 | +0.2 |
| 0.5 | 0.5 | 0.5 | 0.5 | 0.5 | 0.5 | 0.5 | 35 | 38 | +0.1 | ±0 | ±0 | +0.2 |
| 0.5 | 0.5 | 0.5 | 0.5 | 0.5 | 0.5 | 3.0 | 60 | 37 | +0.2 | ±0.2 | ±0 | +0.1 |
| 4.0 | 3.0 | 3.0 | 5.0 | 5.0 | 3.0 | 0.01 | 41 | 35 | +0.1 | +0.1 | +0.9 | +0.9 |
| 5.0 | 3.0 | 3.0 | 5.0 | 5.0 | 3.0 | 0.5 | 55 | 37 | −0.1 | +0.2 | +0.8 | +0.5 |

Table 7-continued

| Additives (mole %) | | | | | | | Electrical Properties of Resultant Resistor | | Change Rate after DC Life Test (%) | | Change Rate after Impulse Test (%) | |
|---|---|---|---|---|---|---|---|---|---|---|---|---|
| $Bi_2O_3$ | $Co_2O_3$ | MnO | $GeO_2$ | NiO | $TiO_2$ | $Cr_2O_3$ | C at 10mA | n | ΔC at 10mA | Δn | ΔC at 10mA | Δn |
| 5.0 | 3.0 | 3.0 | 5.0 | 5.0 | 3.0 | 3.0 | 62 | 36 | −0.2 | +0.3 | +0.9 | +0.8 |

Table 8

| Sample No. | Heating Cycle Test (%) | | Humidity Test (%) | |
|---|---|---|---|---|
| | Δc | Δn | Δc | Δn |
| Example 2 | −4.9 | −6.5 | −5.2 | −6.8 |
| Example 3 | −2.8 | −5.7 | −3.7 | −5.4 |
| Example 4 | −3.8 | −5.5 | −3.5 | −4.5 |
| Example 5 | −2.5 | −2.5 | −1.3 | −2.2 |
| Example 6 | −1.0 | −1.2 | −1.3 | −1.5 |
| Example 7 | −0.3 | −0.2 | −0.5 | −0.6 |

What is claimed is:

1. A voltage-dependent resistor of the bulk type comprising a sintered body consisting essentially of 0.1 to 5.0 mole percent of bismuth oxide ($Bi_2O_3$) and 0.01 to 5.0 mole percent of germanium oxide ($GeO_2$), the remainder being zinc oxide and electrodes applied to opposite surfaces of said sintered body.

2. A voltage-dependent resistor of the bulk type consisting essentially of 0.1 to 5.0 mole percent of bismuth oxide ($Bi_2O_3$), 0.01 to 5.0 mole percent of germanium oxide ($GeO_2$), 0.1 to 5.0 mole percent of nickel oxide (NiO), the remainder being zinc oxide and electrodes applied to opposite surfaces of said sintered body.

3. A voltage-dependent resistor of the bulk type comprising a sintered body consisting essentially of 0.1 to 5.0 mole percent of bismuth oxide ($Bi_2O_3$), 0.01 to 5.0 mole percent of germanium oxide ($GeO_2$), 0.1 to 3.0 mole percent of cobalt oxide ($Co_2O_3$) and 0.1 to 3.0 mole percent of manganese oxide (MnO), the remainder being zinc oxide and electrodes applied to opposite surfaces of said sintered body.

4. A voltage-dependent resistor of the bulk type comprising a sintered body consisting essentially of 0.1 to 5.0 mole percent of bismuth oxide ($Bi_2O_3$), 0.01 to 5.0 mole percent of germanium oxide ($GeO_2$), 0.1 to 5.0 mole percent of nickel oxide (NiO), 0.1 to 3.0 mole percent of cobalt oxide ($Co_2O_3$) and 0.1 to 3.0 mole percent of manganese oxide (MnO), the remainder being zinc oxide and electrodes applied to opposite surfaces of said sintered body.

5. A voltage-dependent resistor of the bulk type comprising a sintered body consisting essentially of 0.1 to 5.0 mole percent of bismuth oxide ($Bi_2O_3$), 0.01 to 5.0 mole percent of germanium oxide ($GeO_2$), 0.1 to 3.0 mole percent of cobalt oxide ($Co_2O_3$) and 0.1 to 3.0 mole percent of manganese oxide (MnO), 0.1 to 3.0 mole percent of titanium oxide ($TiO_2$) and 0.01 to 3.0 mole percent of chromium oxide ($Cr_2O_3$), the remainder being zinc oxide and electrodes applied to opposite surfaces of said sintered body.

6. A voltage-dependent resistor of the bulk type comprising a sintered body consisting essentially of 0.1 to 5.0 mole percent of bismuth oxide ($Bi_2O_3$), 0.01 to 5.0 mole percent of germanium oxide ($GeO_2$), 0.1 to 5.0 mole percent of nickel oxide (NiO), 0.1 to 3.0 mole percent of cobalt oxide ($Co_2O_3$), 0.1 to 3.0 mole percent of manganese oxide (MnO), 0.1 to 3.0 mole percent of titanium oxide ($TiO_2$) and 0.01 to 3.0 mole percent of chromium oxide ($Cr_2O_3$), the remainder being zinc oxide and electrodes applied to opposite surfaces of said sintered body.

* * * * *